United States Patent [19]

Cook

[11] Patent Number: 4,647,352

[45] Date of Patent: Mar. 3, 1987

[54] STRIPPING COMPOSITION AND PROCESS FOR SELECTIVE REMOVAL OF ELECTROLESS APPLIED NICKEL

[75] Inventor: Terry L. Cook, Overland Park, Kans.

[73] Assignee: ACRA, Inc., Parkville, Mo.

[21] Appl. No.: 792,749

[22] Filed: Oct. 30, 1985

[51] Int. Cl.[4] ..... C25F 5/00

[52] U.S. Cl. ..... 204/146

[58] Field of Search ..... 204/146

[56] References Cited

U.S. PATENT DOCUMENTS 4,356,069 10/1982 Cunningham ..... 204/146

*Primary Examiner*—T. M. Tufariello

*Attorney, Agent, or Firm*—Schmidt, Johnson, Hovey & Williams

[57] ABSTRACT

A water-based composition for selective stripping of electroless applied nickel from ferrous, titanium and aluminum substrates is disclosed which includes a quantity of a chromic acid which functions as an oxidizing and electrolytic agent, an amount of globular sodium bisulfite which causes the chromium in the solution to substantially remain in a trivalent state, and a sufficient amount of phosphoric acid as a catalyst to enhance removal of electroless applied nickel by the oxidizing and electrolytic agent. Accelerated removal of electroless applied nickel is accomplished by confining the stripping composition in an enclosure, introducing a nickel-coated substrate into the stripping bath, providing a ferrous surface in the bath, connecting a DC source to the substrate serving as an anode while the ferrous surface functions as the cathode, maintaining the DC source at a voltage of about 6 volts, and heating the bath to a temperature of about 120° F.

14 Claims, No Drawings

STRIPPING COMPOSITION AND PROCESS FOR SELECTIVE REMOVAL OF ELECTROLESS APPLIED NICKEL

BACKGROUND OF THE INVENTION

1. Field of the Invention

This invention relates to the field of metal plating and stripping and particularly to an improved composition permitting accelerated removal of electroless deposited nickel from ferrous, titanium and aluminum substrates.

Electroless nickel has found application in many fields because of the ease with which it may be applied to various metals while providing effective corrosion resistance and desirable engineering properties at microthickness levels. In recent years, procedures for applying the nickel coatings have advanced to a point where the layer of nickel admirably serves its purpose of protecting the surface of the metal substrate but removal has become a vexatious and troublesome problem.

2. Description of the Prior Art

Solutions for stripping electroless applied nickel for many years were primarily based on inclusion of cyanide compounds as oxidizing and electrolytic agents in the presence of a caustic compound. Usually, sodium cyanide was dissolved in a water solution containing potassium or sodium hydroxide. Efforts were made to enhance functionality of the stripping solution by incorporation of additives. One of the most effective in this respect was found to be sodium metanitrobenzene sulfonate. Although this composition worked effectively to remove the nickel coating if the part to be stripped was allowed to remain in the bath for a sufficient period of time (often as long as several days to a month), and the solution maintained at an elevated temperature of about 120° F. to about 130° F., disposal of the stripping bath presented real problems not only because of the difficulty of safely disposing of the cyanide solution, but equally as importantly, the amount of nickel present in the bath presented real challenges to disposal service organizations. Furthermore, the time of removal inherently increased the cost of the stripping operation.

Although electroless applied nickel has advantages as pointed out, the use of such coatings has been found to present problems if need arises for removal thereof because of the high cost of stripping. In recent years, it has been found that removal can cost from two to ten times the amount charged for application to the metal parts.

Efforts to solve the environmental problems relating to disposal of cyanide stripping solutions which include relatively large concentrations of nickel therein have been directed primarily to provision of stripping agents which do not include cyanide as a component part. Efforts to increase the effectiveness of caustic solutions have for the most part involved the incorporation of amine-based additives such as EDTA or similar amines along with additional stripping enhancers. However, these stripping solutions have been found to have a relatively short life since they can only absorb a limited amount of nickel and disposal of the strippers in accordance with environmental regulations has not been totally solved as of yet.

SUMMARY OF THE INVENTION

It has now been found that effective stripping of electroless applied nickel from ferrous, titanium and aluminum substrates may be accomplished in times far less than was the case with previously available solutions without attendant environmental disposal problems by virtue of the provision of a stripping composition which is selective for electroless applied nickel. The composition includes a quantity of a chromium-based acidic oxidizing and electrolytic agent, an amount of a compound capable of causing the chromium-based acidic agent to substantially remain in a trivalent state, an acidic catalyst which accelerates removal of electroless applied nickel by the oxidizing and electrolytic agent and sufficient water to provide for at least partial dissolution of the ingredients of the composition therein.

Accelerated stripping is accomplished by containing the stripping composition in a mild steel tank, dipping the part to be stripped in the composition, and applying a 6-volt DC current to the part as the anode of the circuit while the tank itself functions as the cathode. Best results have been obtained by maintaining the stripping bath at a temperature of about 120° F. to about 140° F. Electroless applied nickel on the part to be stripped can effectively be removed in minutes as compared with hours or days in the case of previously available cyanide and amine enhanced caustic solutions.

DETAILED DESCRIPTION OF THE INVENTION

A preferred composition for selective stripping of electroless applied nickel from ferrous, titanium and aluminum substrates may be prepared by combining chromic acid, barium carbonate, globular sodium bisulfite, phosphoric acid, nickel carbonate and water. Best results have been obtained by admixing on a weight basis for each gallon of the composition, 2 pounds of chromic acid and 2 ounces of nickel carbonate. The chromic acid for reasons of economy may be the technical grade normally used for electroplating processes. For each 55 gallons of total stripping solution, 10 pounds of barium carbonate, 20 pounds of globular sodium bisulfite and 2 gallons of phosphoric acid (75%) (approximately 3.5% on a volume basis) are incorporated in the composition. Sufficient water is then provided to make up 55 gallons of the stripping composition. The pH of the preferred solution is about 1 to 1.5.

Best stripping results are obtained by containing the stripping composition in a mild steel open-topped tank having provision to maintain the temperature of the stripper at a temperature of 120° F. to 130° F. When a part to be stripped is dipped in the tank solution, a 6-volt DC current is applied to the nickel coated metal substrate in a manner such that the coated part functions as the anode of the circuit while the steel tank is the cathode. The part to be stripped is maintained in the solution only so long is necessary to effect removal of the nickel coating. In most instances, stripping can be accomplished in a few minutes, which occurs without surface damage to the metal substrate.

It has been found that although best results are obtained by provision of 2 pounds per gallon of stripping solution of chromic acid, good results are possible employing from 1 to 5 pounds of chromic acid per gallon stripper, with better results being exhibited utilizing 2 to 3 pounds of chromic acid per gallon of the stripping composition.

Similarly, the globular sodium bisulfite concentration may be varied such that good results are obtained at levels of 10 to 50 pounds of the bisulfite for each 55 gallons of total stripper solution with better results obtaining when the level of bisulfite is in the range of 30 to 40 pounds per 55 gallons of the stripping composition.

The phosphoric acid (75%) content may be varied to provide a volume thereof from about 0.1% to about 10% of the stripper solution with better results obtaining when the level is maintained in the range of about 1% to 5% on a volume basis.

Barium carbonate is preferably provided in the composition to neutralize any sulfuric acid in the stripping composition which may be present as a result of sulfate impurities in the technical grade chromic acid, or transferred to the stripping bath by drag-in. However, if the chromic acid used is of such nature that it will not cause sulfuric acid to be present in the stripping composition, or steps are taken to absolutely guard against any sulfuric acid drag-in, inclusion of barium carbonate in the composition is optional. However, it has been found that if even minute amounts of sulfuric acid are present in the stripping bath, selective attack on the part to be stripped can occur thus effectively destroying the surface integrity of the part undergoing stripping. This can be especially catastrophic in the case of close tolerance parts such as aluminum computer drive discs or electronic components which have rigid quality control specifications.

The nickel carbonate is an optional additive but is preferred because it allows the pH of the solution to vary within a range of about 1 to 3, although the preferred pH of the solution remains at a level of about 1.

The globular sodium bisulfite is also believed to function as an agent which undermines the phosphide content (3% to 16% by weight) of the electroless nickel deposit, as well as causing the chromium-based acidic agent in the stripping solution to remain in a trivalent state. The phosphoric acid has been found to substantially increase the speed of the stripping and thus appears to serve as a catalytic agent.

Use of a mild steel tank as an enclosure for the stripping bath and connection of such tank to the DC source in a manner such that the tank serves as the cathode of the circuit, causes nickel stripped from the metal substrate, which is initially dispersed in the stripping solution, to eventually plate out on the tank walls in the form of a porous, spongy deposit which is apparently combined with some chrome. This deposit on the walls of the mild steel tank does not interfere with the stripping operation and a tank can have a useful life of many years even though a deposit of nickel has built up on the surface thereof to a significant extent. In the alternative though, if the stripper desires to use a lined tank instead of a vessel having mild steel walls, a ferrous metal auxiliary cathode may be immersed in the stripping solution and electrically connected in the DC circuit.

The electrical current connected to the part as an anode and the mild steel tank wall or auxiliary steel cathode is preferably supplied from a 12-volt rectifier having a 1,000 amp rating. It is to be understood that the amps drawn during removal of electroless nickel from a metal substrate is a function of the surface area of the part in the instance where the voltage is maintained constant, as for example at the recommended 6-volt level.

I claim:

1. A composition for selective stripping of electroless applied nickel from ferrous, titanium and aluminum substrates comprising:

a quantity of chromic acid as an oxidizing and electrolytic agent;

an amount of sodium bisulfite for causing the chromium-based acidic agent to substantially remain in a trivalent state;

a phosphorus-containing catalyst which accelerates removal of electroless applied nickel by the oxidizing and electrolytic agent; and sufficient water to provide for at least partial dissolution of the ingredients of the composition therein, there being from about 1 pound to about 5 pounds per gallon of added water of chromic acid in the composition, about 10 pounds to about 50 pounds of said sodium bisulfite, and about 0.1% to about 3% of said catalyst on a volume basis.

2. A composition for selective stripping of electroless applied nickel from ferrous, titanium and aluminum substrates as set forth in Claim 1, wherein in 55 gallons of solution there is provided 2 pounds per gallon of chromic acid, 20 pounds of globular sodium bisulfite, 2 gallons of phosphoric acid (75%), and the remainder water.

3. A composition for selective stripping of electroless applied nickel from ferrous, titanium and aluminum substrates as set forth in claim 1, wherein is provided a metal carbonate material in the composition capable of reacting with any sulfuric acid in the solution and resulting from sulfate impurities in the chromic acid.

4. A composition for selective stripping of electroless applied nickel from ferrous, titanium and aluminum substrates as set forth in claim 3, wherein said material is barium carbonate present in an amount from about 1 pound to about 10 pounds for each 55 gallons of solution.

5. A composition for selective stripping of electroless applied nickel from ferrous, titanium and aluminum substrates as set forth in claim 4, wherein is provided about 5 pounds of barium carbonate for each 55 gallons of solution.

6. A composition for selective stripping of electroless applied nickel from ferrous, titanium and aluminum substrates as set forth in claim 1, wherein is provided an amount of nickel carbonate in the composition.

7. A composition for selective stripping of electroless applied nickel from ferrous, titanium and aluminum substrates as set forth in claim 6, wherein said nickel carbonate is present in an amount of about 1 ounce to about 5 ounces on a weight basis per gallon of the composition.

8. A composition for selective stripping of electroless applied nickel from ferrous, titanium and aluminum substrates as set forth in claim 7, wherein said nickel carbonate is present in an amount of about 2 ounces on a weight basis per gallon of the composition.

9. A method for selectively stripping electroless applied nickel from ferrous, titanium and aluminum substrates comprising:

preparing a stripping bath containing a quantity of chromic acid oxidizing and electrolytic agent, an amount of globular sodium bisulfite capable of causing the chromiumbased acidic agent to substantially remain in a trivalent state, phosphoric acid catalyst which accelerates removal of a electroless applied nickel by the oxidizing and electrolytic agent, and sufficient water to provide for at least partial dissolution of the ingredients of the composition therein;

containing the bath in an enclosure;

causing a ferrous surface to be present in the bath contained in said enclosure;

introducing a substrate into the bath having an electroless applied nickel coating thereon;

connecting a source of DC current to the substrate in a manner causing the substrate to serve as an anode in the circuit;

connecting the source of DC current to the ferrous surface in a manner causing such surface to serve as a cathode in the circuit; and maintaining the temperature of the bath at a level within the range of about 70° F. to about 160° F.

10. A method for selectively stripping electroless applied nickel from ferrous, titanium and aluminum substrates as set forth in claim 9, wherein said temperature is maintained at a level of about 120° F.

11. A method for selectively stripping electroless applied nickel from ferrous, titanium and aluminum substrates as set forth in claim 9, wherein the DC current is maintained at a voltage of about 6 volts.

12. A method for selectively stripping electroless applied nickel from ferrous, titanium and aluminum substrates as set forth in claim 9, wherein said bath includes barium carbonate to react with any sulfuric acid in the bath.

13. A method for selectively stripping electroless applied nickel from ferrous, titanium and aluminum substrates as set forth in claim 12, wherein is included about 1 to about 5 pounds of chromic acid for each gallon of the bath, and for each 55 gallons of said bath 1 pound to about 10 pounds of barium carbonate, about 10 pounds to about 50 pounds of sodium bisulfite and about 0.1% to about 10% on a volume basis of phosphoric acid.

14. A method for selectively stripping electroless applied nickel from ferrous, titanium and aluminum substrates as set forth in claim 13, wherein is included for each gallon of the bath from about 1 ounce to about 5 ounces on a weight basis of nickel carbonate.

* * * * *